US008844748B2

(12) United States Patent
Blanton

(10) Patent No.: US 8,844,748 B2
(45) Date of Patent: Sep. 30, 2014

(54) CLAMSHELL CLOSURE FOR METAL DRUM

(75) Inventor: Paul S. Blanton, Aiken, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 858 days.

(21) Appl. No.: 11/130,043

(22) Filed: May 16, 2005

(65) Prior Publication Data

US 2005/0269331 A1 Dec. 8, 2005

Related U.S. Application Data

(60) Provisional application No. 60/572,371, filed on May 19, 2004.

(51) Int. Cl.
*B65D 45/32* (2006.01)

(52) U.S. Cl.
CPC ..... *B65D 45/32* (2013.01)
USPC ..... 220/319; 220/320

(58) Field of Classification Search
USPC ..... 220/319, 320, 321; 292/256.6, 256.65, 292/256.67; 215/276, 274, 275
See application file for complete search history.

(56) References Cited

U.S. PATENT DOCUMENTS

| | | | | | |
|---|---|---|---|---|---|
| 2,226,396 | A | * | 12/1940 | Wackman | 292/256.67 |
| 2,404,777 | A | * | 7/1946 | Gaines | 220/320 |
| 2,603,382 | A | * | 7/1952 | Kojan | 292/256.67 |
| 3,790,020 | A | * | 2/1974 | Fine | 220/319 |
| 3,907,349 | A | * | 9/1975 | Kane | 292/256.67 |
| 4,200,316 | A | * | 4/1980 | Kennedy | 292/256.6 |
| 4,314,720 | A | | 2/1982 | Santoni | |
| 4,957,317 | A | | 9/1990 | Jakubas | |
| 5,193,804 | A | | 3/1993 | Smit | |
| 5,193,864 | A | * | 3/1993 | Coleman | 292/256.67 |
| 5,201,437 | A | * | 4/1993 | Burgdorf | 220/601 |
| 5,584,410 | A | * | 12/1996 | Siblik | 220/320 |
| 5,947,320 | A | * | 9/1999 | Bordner et al. | 220/321 |
| 5,971,190 | A | | 10/1999 | Mannino | |
| 6,435,576 | B1 | | 8/2002 | Kusta | |

OTHER PUBLICATIONS

Savannah River Specification No. 1A2-101-00, *Stainless Steel Open Head 55-Gallon Drum Specification*, Feb. 1, 2000.

P.S. Blanton and A.C. Smith, WSRC-MS-2002-00452, *Responses of Conventional Ring Closures of Drum Type Packages to Regulatory Drop Tests with Application to the 9974/9975 Package*, DOE Contract No. DE-AC09-96SR18500, Aug. 5, 2002-Aug. 9, 2002.

A.C. Smith, S.T. Wach and P.T. Mann, *Drop Test Plan for the 6M Specification Closure Investigation*, M-TPL-A-00001, SRTC Acceptance Aug. 18, 2003.

Charles A. McKeel and Allen C. Smith, WSRC-MS-2002-00476, *Strain Gage Test Results of Band-Type Locking Rings for a Typical Drum Type Radioactive Material Package*.

Tsu-te Wu, WSRC-MS-2002-00554, *A Technique for Dynamic Analyses of Containers with Locking-Ring Closures*.

* cited by examiner

*Primary Examiner* — Jeffrey Allen
(74) *Attorney, Agent, or Firm* — J. Bennett Mullinax LLC

(57) ABSTRACT

Closure ring to retain a lid in contact with a metal drum in central C-section conforming to the contact area between a lid and the rim of a drum and further having a radially inwardly directed flange and a vertically downwardly directed flange attached to the opposite ends of the C-section. The additional flanges reinforce the top of the drum by reducing deformation when the drum is dropped and maintain the lid in contact with the drum. The invention is particularly valuable in transportation and storage of fissile material.

13 Claims, 2 Drawing Sheets

CLAMSHELL CLOSURE FOR METAL DRUM

RELATED APPLICATIONS

This application claims priority to U.S. Provisional Patent Application Ser. No. 60/572,371, filed May 19, 2004.

DISCLOSURE OF GOVERNMENT RIGHTS

This invention was made with Government support under Contract No. DE-AC09-96-SR18500 awarded by the United States Department of Energy. The Government has certain rights in the invention.

BACKGROUND OF THE INVENTION

1. Field of the Invention

This invention relates to improved methods for attaching a lid to a metal drum, particularly metal drums used for the storage and shipment of radioactive material. Typical drums of this type are the DOT 6M specification drums having a nominal volume of 55 gallons. The drums are stainless steel and conform to 49 CFR §178.504.

2. Background and Prior Art

Stainless steel drums of this type are used in the packaging for transport of radioactive materials and, frequently, for their storage. The drum is rolled steel, having a single welded seam and has a closed bottom end and an open top end. The open end of the drum has a rolled edge and the lid used to effect closure has a raised rim which partially surrounds the rolled edge of the drum. A gasket nominally seals the lid to the drum and a locking ring is pulled tight in the circumferential direction and typically held in place with a bolt passing through the lugs located on both ends of the gap in the locking ring. The arrangement is familiar to anyone who has handled standard 55-gallon open drums which are typically used in commerce for bulk shipping of solids and liquids.

Packages used for the transportation of radioactive materials are required to pass the Hypothetical Accidents Condition (HAC) 30-Ft. Drop Test. When used to ship fissile materials, the contents are enclosed within the drum using a "overpack" consisting of multiple layers of fiberboard discs about a central canister.

A limited number of closure systems are available for 55-gallon drums but can be simply described as those of the split-ring type which are bolted together and those which involve a lever which puts tension on the ring and is snapped into place using a hook attached to the ring. Some examples are found in U.S. Pat. No. 4,314,720 to Santoni which uses a locking lever; U.S. Pat. No. 4,957,317 to Jakubas which uses a shuttle wrench and bolt to make the drum tamperproof; U.S. Pat. No. 5,193,804 to Coleman which discloses a spring in the locking ring 180° from the bolt lugs; U.S. Pat. No. 5,971,190 to Manning which adds a pair of projections to the lugs to improve alignment; and, U.S. Pat. No. 6,435,576 B1 to Kusta, which adds a jam nut between lugs to improve alignment. Specification No. 1A2-102-00 describes United Nations designation UN 1A2 as a required packaging when an open head steel drum is used and requires a stainless steel locking ring, welded lugs, one lug threaded and a stainless steel bolt having a nominal minimum size of 0.625 inches. The closure is to conform to 49 CFR §178.2(c)(1). No options are specified.

Testing has shown that when a 55-gallon drum is packed to the maximum allowable weight of 640 pounds (weight of contents approximately 460 pounds) the integrity of the package is not guaranteed when dropped from 30 feet onto the open head at an angle which puts the center of gravity directly over the corner (CGOC test). In typical tests, the primary cause of failure appears to be deformation of the rim of the drum. The difficulties are addressed in Blanton, P. S. and A. C. Smith, "*Response of Conventional Ring Closures of Drum Type Packages*" WSRC-MS-2002-00452.

It is an object of this invention to provide a ring closure which does not fail the aforementioned test. It is a second objective of this invention to provide a means for strengthening the rim of the drum without changing the design and method of manufacture of the drum.

It is a third objective of this invention to provide a ring closure which can be applied quickly using the same tools and same skills as are required to use the existing ring closures.

BRIEF SUMMARY OF THE INVENTION

The objectives of this invention may be achieved using a split-ring incorporating the traditional semi-circular or "C" ring of the traditional closure rings but having, in addition, a continuation extending radially inward from the top portion of the standard ring and an additional flange extending vertically downward from the lower continuation of the ring. For fitment to the drum, the preferred ring is in two halves and requires two pairs of lugs and two bolts. However, a single ring with the aforementioned flange attributes is also possible. The advantage of this system, henceforth to be described as a "clamshell," lies in the improved performance in retaining the lid on the drum when dropped in the 30-foot CGOC test. Drum performance is enhanced further when drums are tested using less stringent testing requirements.

DETAILED DESCRIPTION OF THE INVENTION

Figure 1:
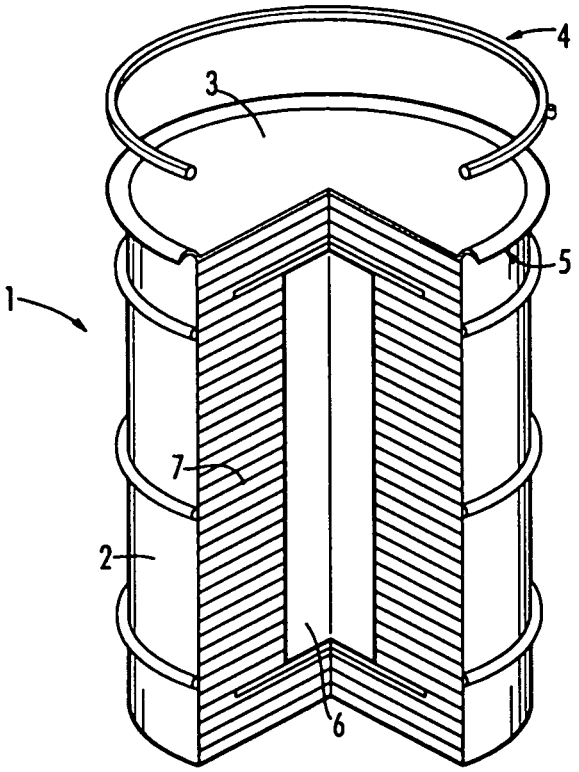
FIG. 1 is a cutaway perspective of the 6M specification drum enclosure.
Figure 2A:
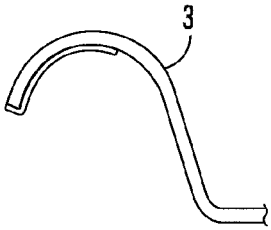
FIG. 2A is a cross section of an end of a drum lid at the point of attachment.
Figure 2B:
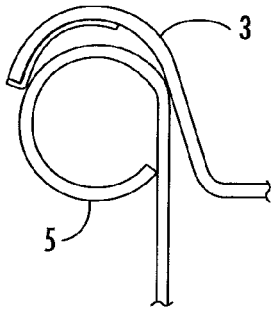
FIG. 2B shows a conventional drum lid applied to a rolled rim top of a standard 55 gallon drum.
Figure 2C:
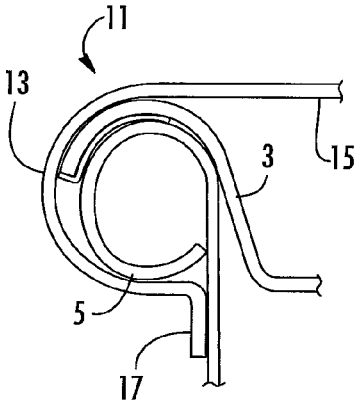
FIG. 2C is a cross-section of the edge of a clamshell closure of this invention applied over the lid of a standard open 55 gallon drum.
Figure 2D:
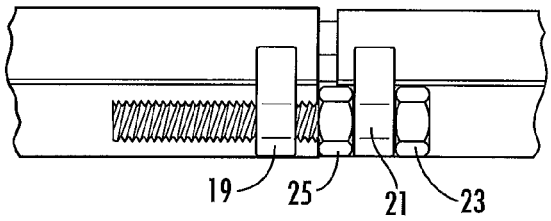
FIG. 2D is a side elevation of the bolt and lug system by which the halves of the clamshell closures are connected on the drum.
Figure 3:
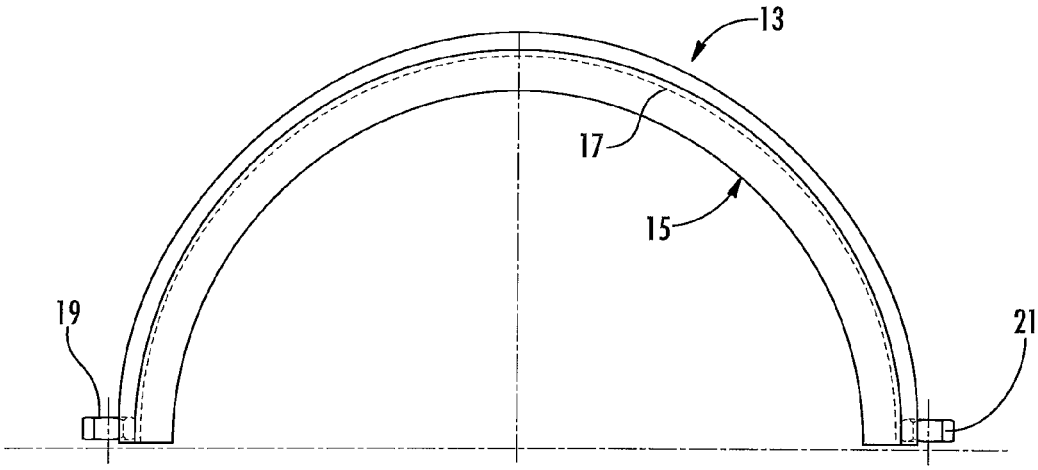
FIG. 3 is a plan view of the clamshell ring.

The clam shell ring will be described with reference to a 6M specification package. The same arrangement may be used with the other standard drum sizes include 110 gallons, 80 gallons, 60 gallons, 45 gallons, 35 gallons and 30 gallons. A 55-gallon drum 1 complete with lid and closure has a standard size, ribbed drum 2, a lid 3, and a closure ring 4. The lip of the drum 5 is curved to accept the curvature of the lid 3 and the closure ring 4 forms a semi-circle or "C" to attach the lid to the rim of the drum. The inner container for radioactive material 6 is over-packed using cane fiber-board 7. FIG. 2A shows the edge of a typical drum lid. FIG. 2B shows the lid applied to the rim 5 of a drum. FIG. 2C shows the clamshell 11 having a curved portion 13 wrapping around the lip of the lid 3 and having a flange 15 extending radially inwardly over the lid and a vertically downward flange 17 which conforms to the side of the drum. The clamshell ring comes in two halves joined by a pair of bolts. In each case, a threaded lug 19 is at one end of the clamshell ring and a second smooth-bore lug 21 is at the other end. A bolt 23 passes through the smooth opening in the first lug 21 and into the threaded lug 19. The locking nut 25 is used to secure the bolt. When viewed from above, as in FIG. 3, it may be seen that the semi-circular portion of the clamshell originates at one end in lug 19 and terminates at the other end at lug 21. Radially inwardly directed flange 15 extends inwardly beyond the curvature of the lid to prevent the lid from completely separating from the drum upon failure. Further, vertically downward flange 17 extends below the radially inwardly directed flange 15 around the curved portion 13 with the first and second lugs 19 and 21 directly welded to both the curved portion 13 and vertically downward flange 17.

Numerous analyses have been made of the modes of failure of open top steel drums when dropped at various angles and from different heights. In addition to the aforementioned publication WSRC-MS-2002-00452, reference is made to McKeel, C. A. and A. C. Smith, "*Strain Gage Test Results of Band-Type Locking Rings*" WSRC-MS-2002-00476, and Wu, T., "*A Technique for Dynamic Analyses of Containers with Locking-Ring Closures*", WSRC-MS-2002-00554. In every instance, separation of the lid from the drum attends deformation of the lid and/or the drum at the point of their contact, not necessarily at the point of impact.

The publication WSRC-MS-2002-00452 describe comparative tests using the clamshell ring, a standard closure ring, a plywood reinforcement insert at the top of the pack and a snap-on "J" clamp which is typically used in multiples.

The data in publication WSRC-MS-2002-00452 clearly show the mode of failure and the extent of failure when the standard closure is applied. Improvement may be found by reinforcing the drum, because it is evident that the primary damage is instigated by deformation of the rim of the drum and that this damage results in deformation of the lid, and in severe cases, deformation of the locking ring.

While not being bound by any theory, it is believed that the clamshell securing ring operates by reinforcing the rim of the drum both by increasing the effective wall thickness of the drum adjacent to the downwardly directed flange 17, and by increasing the web thickness to the radially directed flange 15. In addition, flange 15 prevents slightly deformed lid from leaving the confines of the enclosure as is apparent in the failure of the conventional closure ring. In the preferred embodiments, the clamshell ring is formed from a heavier gauge metal than the lid and drum, thereby being less likely to deform. This prevents the top of the drum from deforming in the region of the lip of the drum.

This invention has been described in terms of a representative example. Detailed modifications such as those which would become apparent to a person with ordinary skill in the art are subsumed within the scope and spirit of the invention. The invention is further described in the attached representative claims.

The invention claimed is:

1. A closure ring for attaching a lid to an open top drum comprising:

at least two curved members collectively forming the circumference of members of a circle, said members each having a first lug at one end of the member which lug is threaded and a second lug at the other end of the member which is smooth bored;

said members characterized by a semi-circular cross-section portion corresponding to a rolled rim of the drum, a flat section extending a distance radially inward of the semi-circular portion over a part of the top of the drum and a flange extending at approximately 90° to the opposite end of the semi-circular portion that is parallel and conforms to a vertically extending side of the drum that is contiguous with the rolled rim of the drum and is curved about an axis of the drum, wherein the flange contacts the vertically extending side along the curved circumference of the vertically extending side, wherein the flange extends from the semi-circular portion a distance in an axial direction of the drum and not in a radial direction of the drum at any point from the semi-circular portion to a bottom terminal end of said flange, wherein the first and second lugs are directly welded to the semi-circular portion and the flange beneath the flat section and the semi-circular portion, wherein the lugs extend from the semi-circular portion in the axial direction of the drum so as to extend along the entire axial length of the flange such that the bottom terminal end of the flange is located in the axial direction at a position that is not below an axial position of a bottom terminal end of the first lug in the axial direction;

wherein the semi-circular portion has an outer surface that has an upper portion that engages and terminates at the flat section in the axial direction, and wherein the outer surface of the semi-circular portion has a lower portion that engages and terminates at the upper portion and the flange in the axial direction;

wherein said members engage a drum lid that has a horizontal portion radially inwardly disposed and contiguous with a vertically extending portion that is radially inwardly disposed and contiguous with a curved portion, wherein said flat section is free from contact with the horizontal portion and vertically extending portion and the radially inward distance of the flat section extends beyond the vertically extending side of the drum and over a radial length of the horizontal portion beyond the vertically extending portion of the lid along the entire semi-circular length of said member from the one end of said member to the opposite end of said member when in a sealed orientation, wherein the vertically extending portion extends from the curved portion to the horizontal portion in a direction that has a component in both the radial direction and the axial direction of the drum such that the vertically extending portion does not reverse directions in the axial direction from the curved portion to the horizontal portion, and wherein said flat section is located above the horizontal portion such that portions of both the flat section and the horizontal portion are located the same radial distance from the axis of the drum along the entire semi-circular length of said member from said end of said member to said opposite end of said member when in the sealed orientation;

wherein an upper surface of said flat section is flat and forms a top terminal end of said member that extends along the entire semi-circular length of said member from said end of said member to said opposite end of said member that is located radially inwardly beyond the vertically extending side of the drum when in the sealed orientation such that no other portion of said member extends higher than said upper surface of said flat section in the axial direction, wherein the entire said upper surface of said flat section located radially inwardly beyond the vertically extending side of the drum that is the highest point of said member at a same angular position about the axis as said first lug has the same radial distance from the axis as the entire rest of said upper surface of said flat section located radially inwardly beyond the vertically extending side of the drum that is the highest point of said member from said angular position of said first lug to said opposite end of said member;

wherein the semi-circular portion, the flange, and the flat section comprise a single integral piece and comprise a heavier gauge metal than the drum and drum lid that in combination with the radially inward distance of the flat section and the axial distance of the flange reinforce the top of the drum by reducing deformation when the drum is dropped and maintaining the lid in contact with the drum; and wherein the engagement between said first lug and said semi-circular portion is made through an attachment that is arranged such that all attachment between said first lug and said semi-circular portion is located completely lower than said upper surface of said flat section that is located radially inwardly beyond the vertically extending side of the drum in the axial direction when in the sealed orientation.

2. A closure ring according to claim 1 further comprising a bolt having the same thread size as the threaded lug.

3. A closure ring according to claim 2 further comprising a locking nut for securing said bolt.

4. A closure ring according to claim 2 wherein said bolt is passed through said second lug and threaded into said first lug.

5. A closure ring according to claim 1 which is made from steel.

6. A closure ring according to claim 5 which is made from stainless steel.

7. A closure ring for attaching a lid to an open top drum comprising:

at least two curved members collectively forming the circumference of members of a circle, said members having a semi-circular cross-section portion corresponding to a rolled rim of the drum, and said members having a flat section extending a distance radially inward from the semi-circular portion, wherein the flat section extends radially inward of a curved rim of the drum when said members are attached to the lid and the drum, wherein said members engage a drum lid that has a horizontal portion radially inwardly disposed and contiguous with a vertically extending portion that is radially inwardly disposed and contiguous with a curved portion, wherein said flat section is free from contact with the horizontal portion and vertically extending portion and the radially inward distance of the flat section extends beyond a vertically extending side of the drum and over a radial length of the horizontal portion beyond the vertically extending portion of the lid along the entire semi-circular length of said member from one end of said member to an opposite end of said member when in a sealed orientation, wherein the vertically extending portion extends from the curved portion to the horizontal portion in a direction that has a component in both a radial direction and an axial direction of the drum such that the vertically extending portion does not reverse directions in the axial direction from the curved portion to the horizontal portion, and wherein said flat section is located above the horizontal portion such that portions of both the flat section and the horizontal portion are located the same radial distance from an axis of the drum along the entire semi-circular length of said member from said one end of said member to said opposite end of said member when in the sealed orientation;

wherein said members having a flange extending at approximately 90° to the opposite end of the semi-circular portion from the flat section that is parallel and conforms to the vertically extending side of the drum that is contiguous with the rolled rim of the drum and is curved about an axis of the drum, wherein the flange contacts the vertically extending side along the curved circumference of the vertically extending side, wherein the flange extends from the semi-circular portion a distance in the axial direction and not in the radial direction at any point from the semi-circular portion to a bottom terminal end of said flange;

wherein said members having a first lug configured for engagement with a bolt for use in drawing the members together, wherein said first lug is threaded and directly welded to the semi-circular portion and the flange beneath the flat section and the semi-circular portion;

wherein the semi-circular portion has an outer surface that has an upper portion that engages and terminates at the flat section in the axial direction, and wherein the outer surface of the semi-circular portion has a lower portion that engages and terminates at the upper portion and the flange in the axial direction;

wherein an upper surface of said flat section is flat and forms a top terminal end of said member that extends along the entire semi-circular length of said member from said end of said member to said opposite end of said member that is located radially inwardly beyond the vertically extending side of the drum when in the sealed orientation such that no other portion of said member extends higher than said upper surface of said flat section in the axial direction, wherein the entire said upper surface of said flat section located radially inwardly beyond the vertically extending side of the drum that is the highest point of said member at a same angular position about the axis as said first lug has the same radial distance from the axis as the entire rest of said upper surface of said flat section located radially inwardly beyond the vertically extending side of the drum that is the highest point of said member from said angular position of said first lug to said opposite end of said member;

wherein the semi-circular portion, the flange, and the flat section comprise a single integral piece and comprise a heavier gauge metal than the drum and drum lid that in combination with the radially inward distance of the flat section and the axial distance of the flange reinforce the top of the drum by reducing deformation when the drum is dropped and maintaining the lid in contact with the drum; and wherein the engagement between said first lug and said semi-circular portion is made through an attachment that is arranged such that all attachment between said first lug and said semi-circular portion is located completely lower than said upper surface of said flat section that is located radially inwardly beyond the vertically extending side of the drum in the axial direction when in the sealed orientation.

8. A closure ring according to claim 7 wherein said first lug is located at one end of the member and wherein said members having a second lug at the other end of the member which is smooth bored.

9. A closure ring according to claim 8 further comprising a bolt having the same thread size as the threaded lug.

10. A closure ring according to claim 9 further comprising a locking nut for securing said bolt.

11. A closure ring according to claim 10 wherein said bolt is passed through said second lug and threaded into said first lug.

12. A closure ring according to claim 7 which is made from steel.

13. A closure ring according to claim 12 which is made from stainless steel.

* * * * *